United States Patent [19]

Niederjohn et al.

[11] 4,091,349

[45] May 23, 1978

[54] HIGH VOLTAGE WINDING LEAD AND TERMINAL STRUCTURE

[75] Inventors: Wayne M. Niederjohn, Chesapeake; John R. Underwood, Portsmouth, both of Va.

[73] Assignee: General Electric Company, Portsmouth, Va.

[21] Appl. No.: 644,980

[22] Filed: Dec. 29, 1975

[51] Int. Cl.[2] ..... H01F 15/10

[52] U.S. Cl. ..... 336/192; 336/198; 363/68

[58] Field of Search ..... 321/2, 8 R, 27 R, 46; 315/411; 178/DIG. 11; 336/107, 185, 192, 208; 323/49

[56] References Cited

U.S. PATENT DOCUMENTS

| | | | |
|---|---|---|---|
| 1,235,081 | 7/1917 | Torchio et al. | 336/185 |
| 3,117,294 | 1/1964 | Muszynski et al. | 336/198 |
| 3,131,371 | 4/1964 | Brekke et al. | 336/198 |
| 3,445,797 | 5/1969 | Otto | 336/208 |
| 3,886,434 | 5/1975 | Schreiner | 363/68 |
| 3,947,749 | 3/1976 | Kimura et al. | 178/DIG. 11 |
| 3,947,795 | 3/1976 | Donelly et al. | 336/192 |

*Primary Examiner*—W. M. Shoop, Jr.

[57] ABSTRACT

High voltage winding lead and terminal structures are disclosed. In the winding of slot wound transformers by means of a plurality of coils of fine wire, wherein each coil is of narrow width and large diameter, a severe problem of corona discharge is present in trying to make a connection to the inner end of each of the winding coils. To solve this problem, relatively wide members are provided on the coil form to form the winding slots. Grooves are provided in these members with a conductor of large cross section being placed in the groove to make an electrical connection with the inner end of each of the winding coils. Preferably, the large conductor is mounted tangent to the inner turn of the coil and the fine wire of the coil is pulled in contact with the conductor of large cross section by automatic winding machinery.

7 Claims, 10 Drawing Figures

FIG. 1
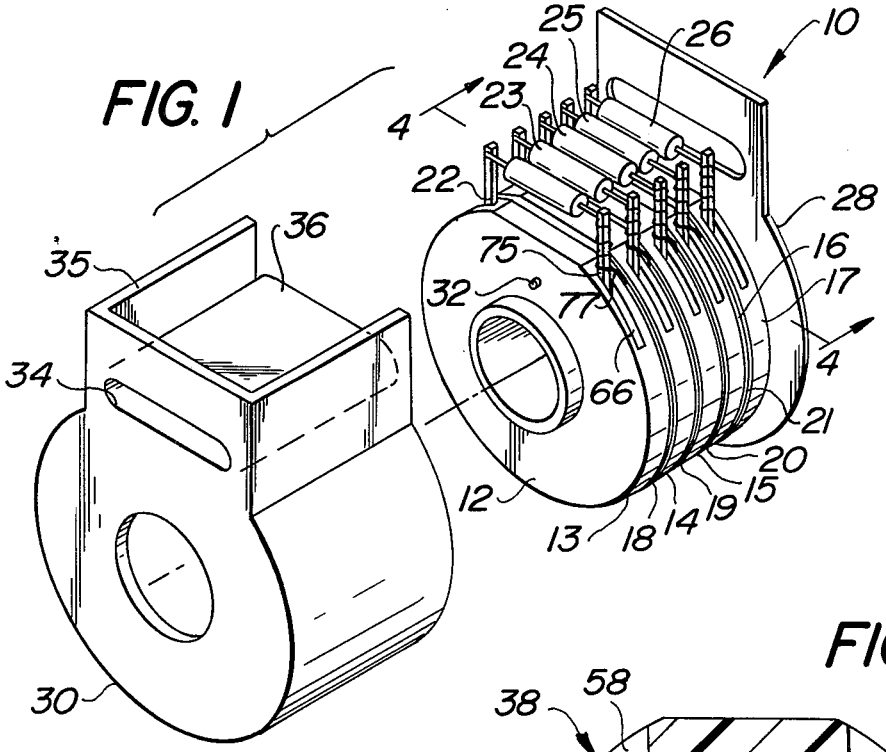
FIG. 3
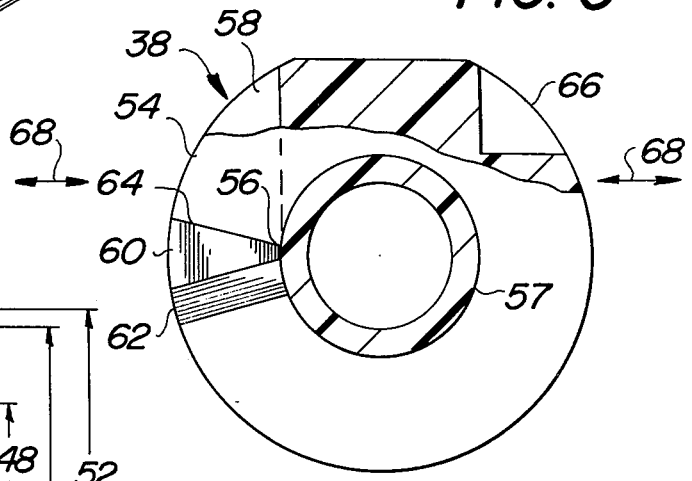
FIG. 2
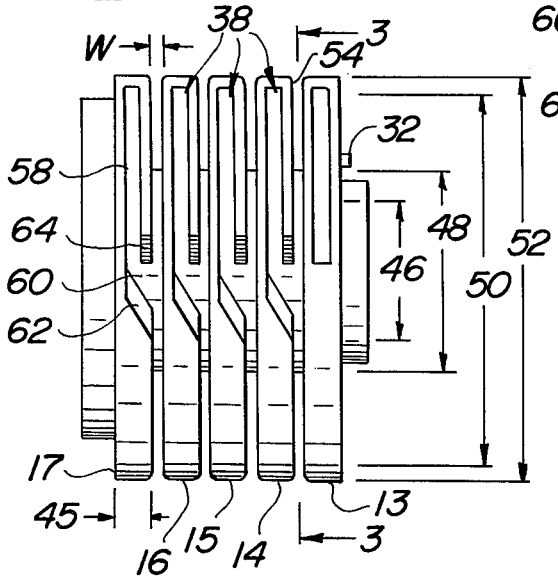
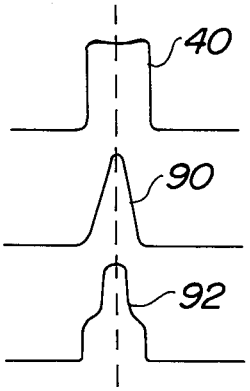
FIG. 7

HIGH VOLTAGE WINDING LEAD AND TERMINAL STRUCTURE

CROSS-REFERENCE TO RELATED APPLICATION

The subject matter of this application is disclosed, in part, in an application of Eugene K. Von Fange et al., Ser. No. 644,979 now U.S. Pat. No. 4,039,924, entitled "High Voltage Winding Assembly With Improved Regulation" filed the same day as this application and assigned to the assignee herein.

BACKGROUND OF THE INVENTION

The present invention relates to high voltage winding lead and terminal structure. More particularly, the present invention relates to a high voltage winding lead and terminal structure which substantially decreases the probability of corona breakdown between the winding and the electrical connection to the inner turns of the winding.

In high voltage windings used in television receivers and other applications to generate high voltages, a potential difference of several thousand volts is often present between the outer turns and inner turns, or in other words, between opposite ends of the winding. In many applications, this potential difference may be 10,000 to 30,000 volts. For example, in generating the approximately 30,000 volts required for the anode of the typical cathode ray tube in a television receiver, a high voltage winding is used on the horizontal output or fly back transformer. In the slot wound transformer as disclosed herein, a large potential difference would exist between the inner and outer turns of the windings of each slot. For example, as disclosed in a preferred embodiment which utilizes four slot windings, the potential difference across each of these windings would be approximately 8 to 10 kilovolts (hereinafter sometimes designated kv.).

In slot wound transformers the possible corona breakdown problem exists with respect to making a connection to the first of the high voltage slot windings and also with respect to making crossover connections between the slot wound windings. Certain types of slot wound transformers have been used in the past. For example, U.S. Pat. No. 3,573,694 — Eugene K. Von Fange et al, assigned to the assignee herein, discloses a slot wound transformer provided with progressively increasing diameters for the high voltage slots. Prior to the teachings of that patent, slits at right angles to the windings were provided in the partition members between the slot windings in order to enable the crossover connection between windings. U.S. Pat. No. 3,573,694 discloses the concept of slanting the slits at an acute angle to the central axis of the coil form in order to increase the electrical path length between the windings. However, these prior teachings require that the fine wire making up the winding be drawn down adjacent a number of layers of the winding thereby increasing the potential for corona discharge between the fine crossover wire and the turns of fine wire of the winding. For a given number of turns in a winding, the problem of corona breakdown becomes more acute as the number of component coils in the winding is reduced and replaced with fewer coils of greater height. This is because corona breakdown propensity is a direct function of the potential difference from the start to finish of each coil. solves these problems by means of novel structure which effectively increases the diameter of the electrical conductor which traverses the distance between the start and finish turns of each coil.

SUMMARY OF THE INVENTION

An advantage of the present invention is that it reduces the probability of corona breakdown in a high voltage winding between the start lead and the rest of the winding during transformer operation.

Another advantage of the present invention is that it provides a substantial amount of coil form insulation material between the start lead and the remainder of the winding.

Another advantage of the present invention is that it prevents insulation breakdown on the start lead and on various turns of the high voltage winding thereby increasing reliability of the winding and transformer.

Still another advantage of the present invention is that it provides a means of substantially reducing the probability of corona breakdown which leans itself to coil winding by automatic winding machinery.

Another advantage of the present invention is that it provides an economical means of reducing corona discharge in the high voltage winding of a transformer.

Briefly, in accordance with the present invention, means for providing a corona free connection to the inner end of a high voltage winding is provided. A coil form is provided with a portion for receiving the winding and at least one member adjacent the winding. In the usual case, a member will be provided on each side of the winding. However, at least one member adjacent each winding will be provided with a groove extending from its outer surface down to a depth substantially equal to that of the inside end of the winding. A conductor is mounted in the groove and extends from at least the outer surface to a depth substantially equal to that of the inside end of the winding. The conductor is provided with a cross sectional dimension which is large in comparison to the diameter of the wire of the winding. The inside end of the winding is connected to the conductor.

In a preferred embodiment, the conductor is mounted tangent to the inside turn of the winding thereby enabling winding by automatic winding machinery. The wire may be wrapped around the large cross section or large diameter conductor and drawn tight along the length of the conductor when wrapped by the automatic winding machinery.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a view in perspective of a high voltage winding lead and terminal structure in accordance with the present invention.

FIG. 2 is a side elevation view of a coil form without the windings showing the groove lead-in structure of a coil form in accordance with the present invention.

FIG. 3 is a cross sectional view, partially broken out, taken along line 3—3 of FIG. 2.

FIG. 7 illustrates the output wave form of the high voltage winding.

DETAILED DESCRIPTION OF A PREFERRED EMBODIMENT

Figure 4:
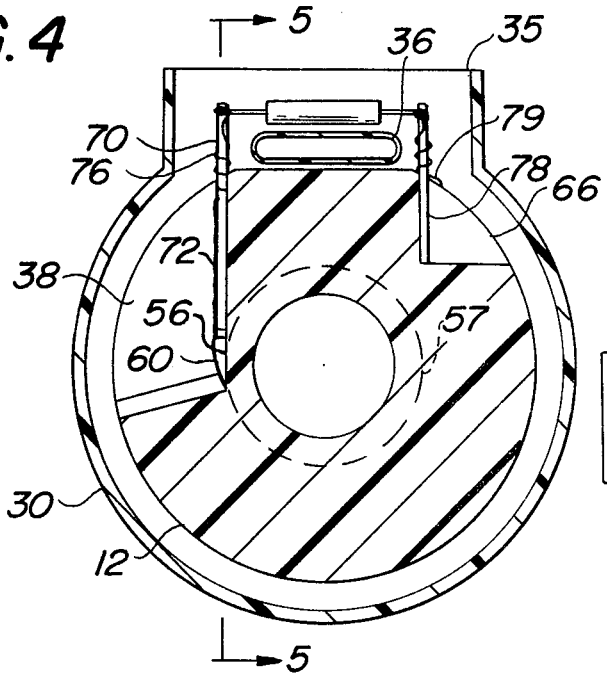
FIG. 4 is a cross sectional view taken along line 4—4 of an assembled FIG. 1.

Referring now to the drawings, wherein like numerals indicate like elements, there is shown in FIG. 1 a high voltage winding 10, often referred to as the tertiary winding of the horizontal output transformer of a television receiver, which utilizes the high voltage lead and terminal structure of the present invention. In the succeeding description, it may be helpful to refer to FIGS. 1, 2, 3, 4 and 5 taken together. A coil form 12 is provided with members or partition members 13, 14, 15, 16 and 17. The partition members 13, 14, 15, 16 and 17 form slots in which coils 18, 19, 20 and 21 are wound to a substantial height. Each coil or winding may have a large potential difference developed along its height.

Figure 6:
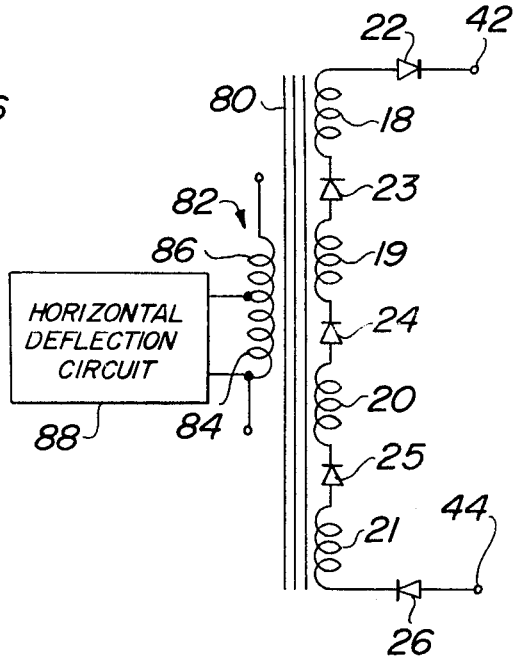
FIG. 6 is a schematic diagram, partially in block diagram form of a high voltage winding and related circuitry.

Referring to FIG. 1 in conjunction with the schematic diagram of FIG. 6, the coils 18 through 21 are connected in series through diodes 23 through 25 and a diode is connected in series at each end of the group of windings 18 through 21. That is, a diode 22 is connected at one end of coil or winding 18 and a second diode 26 is connected to the free end of coil or winding 21. In addition to rectification of the output of the high voltage winding 10, the diodes produce basically a d-c voltage between the windings 18–21 and also reduce the effective stray capacitance of the high voltage winding 10.

Figure 5:
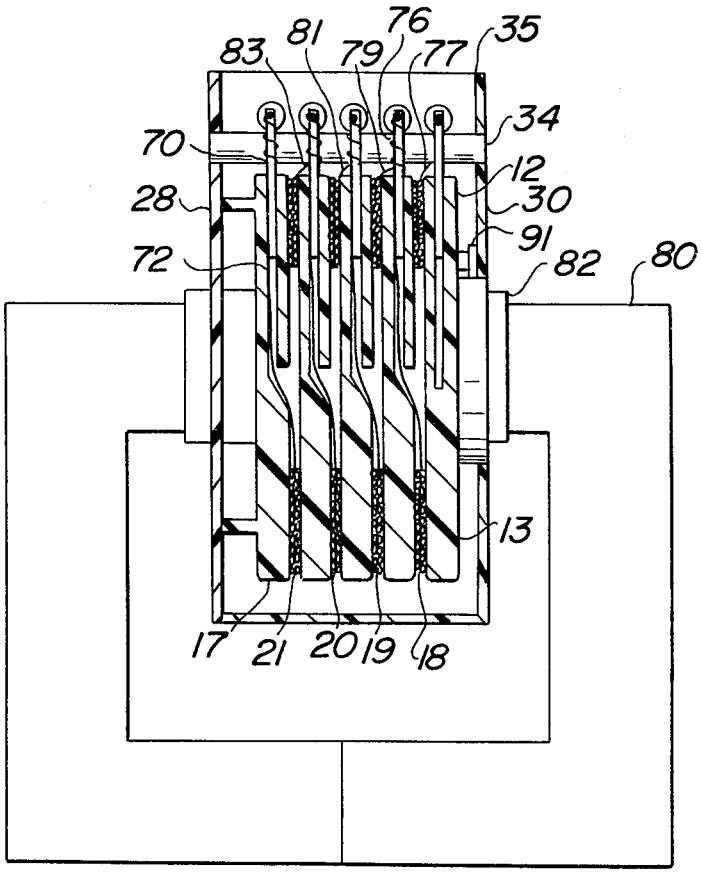
FIG. 5 is a cross sectional view taken along line 5—5 of FIG. 4 with the added illustration of a core means and primary and secondary windings.

High voltage winding 10 is provided with a housing comprised of mating members 28 and 30. Coil form 12 is provided with a projecting pin 32 which mates with a groove, slot or female connection 91 on the inside of member 30 as shown in FIG. 5 for rapidly and accurately positioning member 30 over coil form 12. Housing member 30 is provided with an opening 34. A shaped tubular member 36, as shown in FIG. 4, is provided between the top of the coil form 12 and diodes 22 through 26 to provide thermal insulation between coils 18 through 21 and the diodes. Once housing member 30 is assembled over coil form means 12 against housing member 28, the coil form, windings and diodes are encapsulated by filling the housing through opening 35 with epoxy, silicone or some other suitable insulating compound used for encapsulation. The positioning of the slots or windings 18 through 21 parallel to the pouring direction of the encapsulating compound through opening 35 is important in order to avoid air pockets and voids which adversely affect the electrical properties and reliability of the high voltage winding 10.

Referring now to FIG. 2, there is shown a side elevation view of a coil form 12 of FIG. 1 without the windings 18–21 and diodes 22–26. As may be seen, FIG. 2 is a view of the back side of FIG. 1 illustrating grooves 38 in partition members 13 through 17 for making corona free electrical connections to the inside ends of windings 18 through 21. Grooves 38 receive conductors 70 which will be discussed more fully hereinafter in conjunction with FIGS. 4 and 5.

Coil form 12 is comprised of a dielectric material which is preferably a composition comprising polyphenelyne oxide and polymer which is commercially available from the General Electric Company, Selkirk, N.Y. 12158 under the trademark "NORYL". Preferably, the composition comprising polyphenelyne oxide and styrene polymer is filled with ten percent glass by weight in the form of glass fibers or beads. The glass filling increases the stability of the dissipation factor with frequency and temperature variations, increases the stability of dielectric strength of the material and increases the coil form's mechanical strength.

The relative dimensions of coil form 12 and the relative dimensions of windings 18 through 21 are important for the electrical characteristics in producing a square wave pulse output. In order to produce a square wave pulse output 40, as shown in FIG. 7, from output terminals 42 and 44, as shown in FIG. 6, a preferred embodiment of the invention is provided having dimensions of W equal to approximately 0.08 inch; the width of each of the members 13 through 17, dimension 45, being equal to approximately 0.22 inch, the inner diameter 46 of coil form 12 being equal to approximately 0.96 inch; the inner diameter 48 of windings 18 through 21 being equal to approximately 1.32 inches; the outer diameter 50 of windings 18 through 21 being equal to approximately 2.25 inches, subject to variation depending upon winding wire arrangements, exact diameter of the wire and thickness of enamel or other insulation on the wire; and the outer diameter 52 of coil form 12 being equal to approximately 2.75 inches. Preferably, 885 turns of 34 gauge (American Wire Gauge) wire having a diameter of 6.3 mils or 0.0063 inch are provided for each winding 18 through 21. Although these dimensions are the preferred embodiment and the currently known best mode of practicing the invention, it is understood that these dimensions may vary in a range around the best mode values specified. For example, it is possible to use 36 gauge wire or any wire in the range of 32 to 36 gauge (American Wire Gauge). In other words, wire having a diameter varying from 8 mils down to 5 mils. In essence, a plurality of windings of narrow width and substantial height are required to produce the desired electrical output. Large potential differences are developed across these windings. A difficult problem existed in running the fine wire start leads or crossover leads between the windings down to the inside turn of the windings without causing corona discharges.

Referring now to FIG. 3, there is shown a cross sectional view taken along line 3—3 of FIG. 2 with a portion of wall 54 cut away. FIGS. 2 and 3 taken together with FIGS. 4 and 5 disclose a means of making electrical connection to the inside end of windings 18 through 21 with a minimum probability or potential for corona discharge. Groove 38 is tangent to the inside diameter of the windings at point 56 as shown in FIGS. 3 and 4. Grooves 38 are comprised of a first portion 58 parallel to the windings 18 through 21. A second part of the groove forms an opening 60 into the winding slot. The opening of the groove 60 is provided with tapered surfaces 62 and 64. A groove 66 is provided opposite groove 38 for receiving a terminal pin. The grooves 58, 60 and 66 are open in the directions of arrows 68 thereby allowing production molding by allowing free movement in the directions of double headed arrows 68.

Referring now to FIGS. 4 and 5, the terminal structure and winding arrangement is shown in more detail. As may be seen from the drawings, the windings 18 through 21 are of relatively narrow width and substantial height separated by relatively wide partition members 13 through 17.

Figure 8:
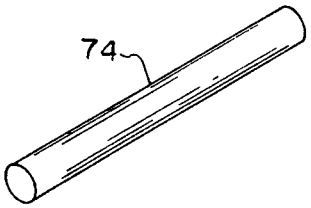
FIG. 8 is a view in perspective of an alternate embodiment of a start lead conductor.

Conductor 70, having large cross sectional dimensions with respect to wire 72 of the winding, is provided in groove 38. Conductor 70 may be force fit into groove 38. However, any other suitable means such as the use of adhesives may be used to bond conductor 70 in place in groove 38. Conductors 70 are tangent to the inner turns of the windings 18 through 21. Conductors 70 may be round, square or any other suitable shape in cross section. Preferably, the conductors are square in the case of force fitting conductors into grooves 38. However, with respect to reducing the potential for corona discharge, a round cross section on conductor 70 is preferable as shown in FIG. 8 at 74. The cross section of conductor 70 is large in relation to the diameter of wire 72 in order to reduce the electric field intensity surrounding the wire thereby reducing the potential for unwanted corona discharge. The difference in potential across a winding in typical use may be on the order of 8 to 10 thousand volts. A fine wire running down along the winding would be subject to an extremely high electric field intensity subjecting it to corona emission and probably corona discharge or arcing.

As shown in FIGS. 4 and 5, wire 72 is wrapped around conductor 70 at 76. Conductor 70 is then inserted into groove 38. Wire 72 is pulled tight against conductor 70 and through opening 60 by automatic winding machinery which is then used to wind the winding. When the winding is completely wound, its outside end 77 is connected to a terminal pin 75 shown in FIG. 1. Terminal pin 75 is similar to terminal pin 78 in groove 66 shown in FIG. 4. End wires 77, 79, 81 and 83 shown in FIG. 5 are connected to terminal pins located behind conductors 70 in FIG. 5.

Figure 9:
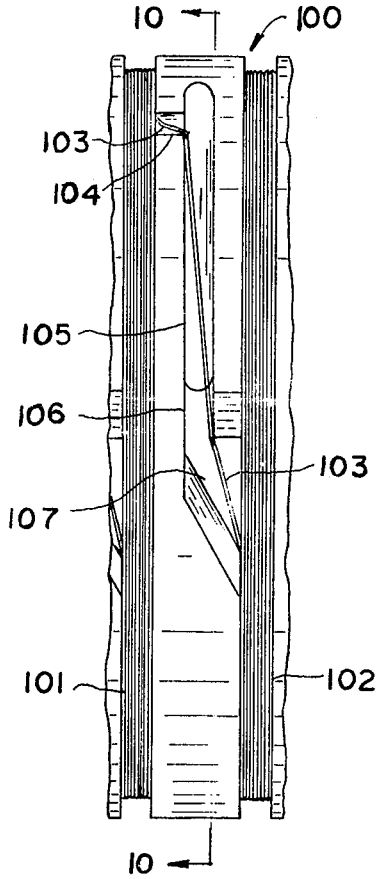
FIG. 9 is an elevation view of another embodiment in accordance with the principles of the present invention.
Figure 10:
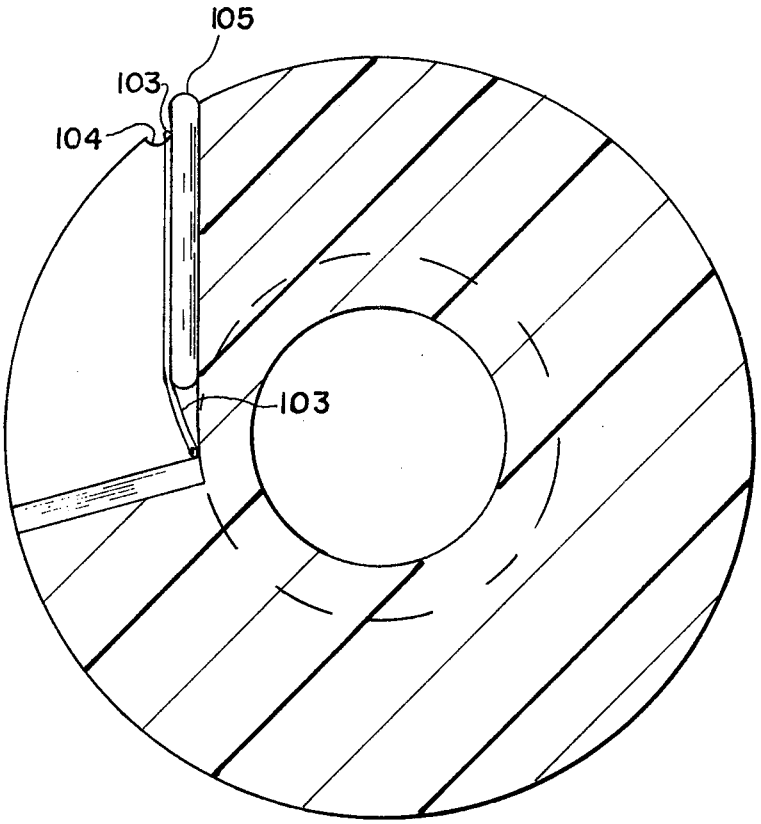
FIG. 10 is a cross-sectional view taken along line 10—10 of FIG. 9.

Referring now to FIGS. 9 and 10, there is shown another embodiment of the present invention which provides a corona-free crossover connection between adjacent windings where an electrical device is not required to be connected in series between adjacent windings. FIGS. 9 and 10 show a portion of a coil form 100 having windings 101 and 102 wound in slots thereof. The finish or outermost wire 103 of winding 101 is pulled through notch 104. The finish wire is drawn tight against at least a portion of conductor 105 in groove 106 and through opening 107 to form the innermost turn of winding 102. In this manner, a continuous strand of wire extends from the outermost turn of one winding to become the innermost turn of an adjacent winding without a likelihood of corona discharge.

Referring again to FIG. 5, there is shown coil form 12 and windings 18 through 21 mounted on a core means 80 with a combined primary and secondary winding 82 mounted between core means 80 and the inner diameter of coil form means 12.

Referring to FIG. 6, there is shown the combined primary and secondary windings 82. The combined primary and secondary winding 82 conserves copper in a conventional manner by using portion 84 of the combined winding as the primary fed by the output of the horizontal deflection circuit 88. Portion 86 of the combined winding 82 in conjunction with the primary winding 84 serves as an auto transformer to provide a horizontal output wave form to the deflection yoke of the cathode ray tube in the conventional manner.

In operation, high voltage winding 10 produces a relatively square wave pulse output 40 as shown in FIG. 7 in response to the fly back pulses present in horizontal output circuitry of the conventional television receiver. This output pulse wave form 40 is in contrast to prior art pulse wave shapes 90 and 92 shown in FIG. 7. In operation, each of the windings 18 through 21 has a relatively large potential difference developed across the winding. The voltage on the turns of the windings near the outside, for example, may be 8 to 10 thousand volts higher than the voltage on the turns near the inside or start end of the winding. Conversely, the inside turns may be 8 to 10 thousand volts higher than the outside turns. In any event, the voltage difference across the two ends of the windings is very substantial and may cause corona discharge problems if the fine winding wire were brought out from the inside end or start end of the winding along the winding. This problem exists not only for the initial windings but also for making connections between the outside turn of one winding and the inside turn of an adjacent winding.

The present invention uses conductors 70 or 74 having a large cross section or diameter, as compared with the diameter of the wire of the windings, mounted in grooves 38 of coil form 12. The conductors 70 or 74 extend at least from the outer surface or outer diameter 52 to a depth substantially equal to that of the inside end of the winding. In other words, the conductors 70 or 74 extend from the outside surface of the coil form down along the windings and parallel to the windings, but separated from the windings by the sides of the grooves or wall 54 as shown in FIGS. 2 and 3. These large cross section conductors are therefore insulated from the windings by the dielectric material of the coil form 12.

In order to enable automatic winding of the windings 18–21 and to simplify the winding process as much as possible, the start of the winding is wrapped around the conductor 70 at its outside end at 76 as shown in FIGS. 4 and 5. The conductor 70 is then inserted in groove 38 and the wire 72 is drawn tight against conductor 70 as described above. Although the wire is still present, electrically, conductor 70 and wire 72 appear as one large conductive mass at the same potential, thereby reducing the probability of corona breakdown or corona discharge. These unique means also aid in preventing breakdown paths sometimes called "treeing" in the coil form dielectric material and, particularly, in wall members 54 which separate the start lead conductors 70 from the windings.

It will be apparent to those skilled in the art that various changes and modifications may be made to the embodiments of the invention disclosed herein within the scope and teachings of the present invention. For example, it is apparent that the conductors 70 and terminal pins 78 may be spaced around coil form 12 for each winding in order to increase the distance between these terminals and conductors in order to reduce the possibility of arcing between them. In other words, the conductor 70 and terminal 78 for each winding would be spaced at different positions around the circumference of coil form 12. Furthermore, it is apparent that various different cross sectional shapes may be used for the conductor 70 and terminal pins 78. Furthermore, different mounting arrangements may be used for the conductors 70 and terminal pins 78. It will also be apparent that wire 72 could be connected to conductor 70 at the inside end of conductor 70. These and other variations will be obvious to those skilled in the art.

In view of the above, the present invention may be embodied in other specific forms without departing from the spirit or essential attributes thereof and, accordingly, reference should be made to the appended claims rather than to the foregoing specification as indicating the scope of the invention.

We claim:

1. A slot wound high voltage winding, comprising:

coil form means provided with a plurality of partition members forming a plurality of slots for receiving windings of a substantial height, each winding being provided with a groove in an adjacent partition member adapted to receive the inside end of said winding and a conductor having a cross-section large in comparison to the diameter of the wire of the winding, said inside end of each of said windings being connected to its respective conductor thereby enabling corona free connection to the inner turn of each winding.

2. A slot wound high voltage winding in accordance with claim 1 wherein said conductors are mounted in said grooves in positions tangent to the inside turns of said windings.

3. A slot wound high voltage winding in accordance with claim 2 wherein said inside end of said winding is connected to said conductor near the outer surface of the coil form and is drawn against the length of said conductor extending into said groove.

4. A slot wound high voltage winding in accordance with claim 1 wherein said grooves are comprised of first parts parallel to said windings and second parts angled from said first parts and extending to said windings enabling the connection of the inside end of said windings to said conductors.

5. A transformer for use in generating a high voltage output from a pulse input, comprising:

coil form means, said coil form means being provided with an inside diameter sufficient to receive a primary winding and being provided with partition members on its outer surface to form a plurality of slots to accept the high voltage windings comprised of a plurality of turns, at least one of said partition members adjacent each of said slots being provided with a groove to accept the inner end of the adjacent one of said high voltage windings and a conductor having a cross-section large in comparison to the diameter of the wire of the winding, said groove having an opening connecting said groove and said slot, said inner end of said winding being connected to said conductor.

6. A transformer in accordance with claim 5 wherein said start conductor is tangent to the inside turn of a winding to be wound in said adjacent slot whereby said winding may be machine wound drawing the winding wire adjacent to said conductor.

7. A transformer in accordance with claim 5 including a coil form means housing provided with an opening positioned in the direction of a radius of said slots whereby an encapsulating dielectric material may be poured into said housing parallel to said slots and windings.

* * * * *